United States Patent [19]

Barnes

[11] 3,931,856

[45] Jan. 13, 1976

[54] METHOD OF HEATING A SUBTERRANEAN FORMATION

[75] Inventor: Allen L. Barnes, Allen, Tex.

[73] Assignee: Atlantic Richfield Company, Los Angeles, Calif.

[22] Filed: Dec. 23, 1974

[21] Appl. No.: 535,162

[52] U.S. Cl. ..... 166/245; 166/248; 166/272

[51] Int. Cl.[2] ..... E21B 43/20; E21B 43/24

[58] Field of Search ..... 166/248, 272, 60, 263, 166/271, 245, 302

[56] References Cited

UNITED STATES PATENTS

| | | | |
|---|---|---|---|
| 2,801,090 | 7/1957 | Hoyer et al. | 166/60 X |
| 2,818,118 | 12/1957 | Dixon | 166/248 |
| 3,103,975 | 9/1963 | Hanson | 166/248 X |
| 3,106,244 | 10/1963 | Parker | 166/248 |
| 3,259,186 | 7/1966 | Dietz | 166/263 |
| 3,380,525 | 4/1968 | Altamira et al. | 166/245 |
| 3,547,192 | 12/1970 | Claridge et al. | 166/248 |
| 3,605,888 | 9/1971 | Crowson et al. | 166/248 |

*Primary Examiner*—Stephen J. Novosad
*Attorney, Agent, or Firm*—Ronnie D. Wilson

[57] ABSTRACT

An improved method of recovering a fluid from a subterranean formation via heating by electrical conduction between a plurality of wells completed therein, the improvement comprising drilling and completing a satellite well open to the formation and adjacent an electrode well, injecting water containing dissolved electrolyte into the formation via the electrode well having an adjacent satellite well, establishing fluid communication between the electrode well and the satellite well, and circulating the water containing dissolved electrolyte between the electrode well and adjacent satellite well. This invention increases the electrical conductivity in the formation and about the wells where the current flux is greatest and makes possible larger current than would otherwise be possible with a given voltage differential. Also disclosed are specific embodiments.

4 Claims, 2 Drawing Figures

METHOD OF HEATING A SUBTERRANEAN FORMATION

Figure 1:
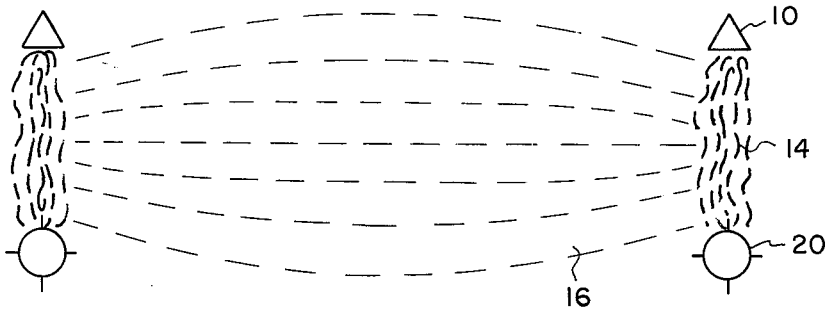

This invention relates to a method of producing fluids from a subterranean formation. More particularly, this invention relates to an improved method for recovering a fluid from a subterranean formation by heating.

A wide variety of fluids are recovered from subterranean formations. These fluids range from steam and hot water geothermal wells through molten sulfur to hydrocarbonaceous materials having greater or lesser viscosity. The hydrocarbonaceous materials include such diverse materials as petroleum, or oil; bitumen from tar sands; natural gas; and kerogen, a substance found in oil shales.

The most common and widely sought fluid to be produced from a subterranean formation is petroleum. The petroleum is usually produced from a well or wells drilled into a subterranean formation in which it is found. A well is producing when it is flowing fluids. The words "to produce" are used in oil field terminology to mean to vent, to withdraw, to flow, etc., pertaining to the passage of fluids from the well.

There are many hydrocarbonaceous materials that cannot be produced directly through wells completed within the subterranean formation in which the fluids are found. Some supplemental operation is required for their production. At least three such materials are kerogen in oil shales, bitumen in tar sands, and highly viscous crude oil in oil-containing formations. The first two frequently involve special production problems and require special processing before a useful product can be obtained. These materials have at least on characteristic in common, however. That is, heat can bring about the necessary viscosity lowering, with or without conversion of the in situ product, to enable hydrocarbonaceous material to be produced from its environment.

Several processes supplying heat in situ have been developed in the past. These processes may employ so-called in situ combustion, or fire flood; steam flood; or similar related recovery projects in which at least one fluid containing or developing the heat is passed through the formation. Liquid blocking, or banking of a liquid, has created problems where injection of a fluid is necessary.

One way to avoid the difficulties with injection of a fluid into a subterranean formation is the use of electrical energy to heat the subterranean formation by electrical conduction. Such electrical conduction occurs primarily through the connate water envelopes surrounding the sand grains or the like in the subterranean formation. Yet, in many formations the connate water saturation is relatively low and the subterranean formation does not have a high electrical conductivity. In the portion of the formation having a large cross-sectional area through which the current can flow, this may pose little problem. This electrical resistivity becomes significant, though, in areas of high current density such as around the wells in which the electrodes are placed in electrical contact with the information.

Electrical conduction of energy to heat a subterranean formation is not without its problems. If the temperature in the electrode wellbore vicinity is not kept below the vaporization temperature of water, the resulting steam will effectively hinder the flow of current into the formation. Also, during heating of a formation, pressures tend to rise and thermal expansion takes place in the reservoir; if fluids are not produced to relieve this pressure, fracture of the reservoir may take place with a resulting loss of fluids contained therein to the overburden or underburden.

Thus, it can readily be seen that the methods of the prior art have not been totally satisfactory in heating a subterranean formation and the fluids therewithin. Particularly, the prior art methods have not alleviated the problems having to do with too high an electrical resistance in the formation and those associated with high temperatures in the electrode wellbore and vicinity and thermal expansion in the reservoir.

Accordingly, it is an object of the present invention to provide an improved method of heating a subterranean formation that alleviates the difficulties of the prior art.

Specifically, it is an object of this invention to provide an improved method of heating a subterranean formation by electrical conduction in which an area of high electrical conductivity is established in the region of greatest current density.

These and other objects will become apparent from reading the descriptive matter hereinafter and the appended claims.

In accordance with this invention, a subterranean formation intermediate a plurality of electrode wells completed therein is heated by electrical conduction and includes the steps of drilling and completing a satellite well in the formation and adjacent an electrode well, injecting water containing dissolved electrolyte into the formation via the electrode well having an adjacent satellite well, establishing fluid communication between the electrode well and the satellite well, and thereafter circulating the water between the electrode well and adjacent satellite well.

Figure 2:
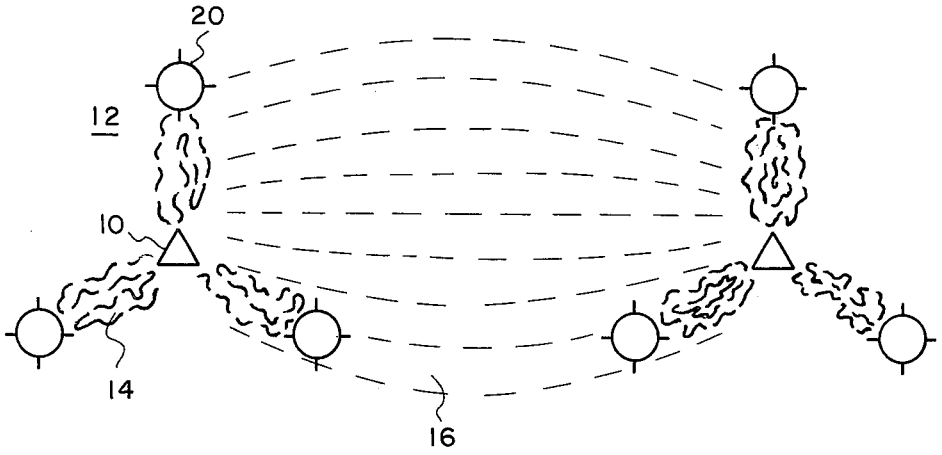

FIGS. 1 and 2 each respectively diagrammatically illustrate a specific embodiment of the present invention. In both figures, similar items are numbered the same.

FIG. 1 illustrates an embodiment of the present invention wherein electrical current 16 is conducted between a pair of electrode systems comprising electrode wells 10 adjacent satellite wells 20 and water 14 containing dissolved electrolyte circulating therebetween within each of said systems to provide an improved method of heating a subterranean formation.

FIG. 2 illustrates an embodiment of the present invention wherein electrical current 16 is conducted between a pair of electrode systems comprising electrode wells 10 adjacent satellite wells 20 and water 14 containing dissolved electrolyte circulating therebetween within each of said systems to provide an improved method of heating a subterranean formation not shown. In each of the electrode systems, the satellite wells 20 are positioned equidistance from electrode wells 10 and each other.

The in situ fluid and the formation are preheated, to mobilize the viscous oil in the formation, by heating with a predetermined electrical current for a predetermined time interval. Production of the mobilized oil intermediate the electrode and satellite well is effected through either the electrode well or satellite well to provide for fluid communication between same. The electrolyte solution circulation between the electrode and satellite well effectively increases the "size" of the electrode by providing a larger area of high electrical conductivity than is possible without the satellite well.

With the "size" of the electrode increased, the area of heating is correspondingly increased between electrode wells which allows more power to be transmitted to the formation in the form of heat energy. Thereafter, for production, it may be necessary to inject a drive fluid such as steam or hot water into the formation via either the electrode or satellite wells.

In one embodiment, the circulation of the electrolyte solution is effected by withdrawing the solution from the satellite well and passing it through a heat exchanger on the surface and reinjecting the cooled solution down the electrode well past conductors (such as cables) therein and through the formation to the satellite well to complete the cycle. The circulation of solution past the conductors in the electrode well allows the current capacity to be increased several-fold by maximizing heat transfer. Corrosion inhibitors may be needed in the solution if cable is uninsulated. Contact between copper and steel should be avoided to prevent electrolytic corrosion.

In another embodiment, solution circulation may be effected by both injecting and withdrawing solution from the electrode wellbore to achieve heat transfer from the conductors and cooling around the wellbore vicinity.

It should be noted that in any solution circulation system contemplated hereunder the temperatures in the wellbore and the fluid temperature outside the electrode can be controlled to a reasonable extent by controlling the rate of circulation in conjunction with measuring instrumentation or estimations from surface fluid temperatures.

In the practice of the invention, a plurality of bore holes are drilled from the surface of the earth into the subterranean formation containing the in situ fluid to be produced. The bore holes are thereafter completed as either electrode or satellite wells. By completion as a well is meant the provision of a flow path for fluid to be injected into or produced from the formation in accordance with conventional oil field technology.

The electrical conductors, such as electrodes, are emplaced in the wells designated as electrodes. The electrodes are connected with the formation by suitable means. For example, they may be connected with a conductive tubing or casing having perforations therein; and the conductive tubing or casing, in turn, is connected with the formation. Even if special conductors are employed intermediate the casing or electrode and the formation, electrical conductivity will be substantially increased if water containing an electrolyte is introduced intermediate the electrodes and the formation for conducting the electrical current therebetween. This is especially so when a satellite well is utilized to have an effectively enlarged electrode via the circulation of electrolyte solution between an electrode well and a satellite well. This will establish electrical contact with the connate water envelopes surrounding the sand grains such that the formation will conduct electricity intermediate the wells when the electrode wells are connected with suitable voltage differential.

The electrodes are connected by suitable connectors, such as those of copper-based alloy where they will be subjected to well fluids, with suitable cable. The cable is then connected with surface equipment having necessary switches, rheostats and the like. The surface equipment affords means for interconnecting the electrical conductors with a source of voltage differential such as a generator, high voltage line or the like.

The satellite wells should be drilled adjacent electrode wells and be completed open to the subterranean formation in order to aid in the production of expansion fluid during the pre-heating period to minimize possible sand problems at the electrode wells and allow for thermal expansion of the reservoir, without fracturing taking place. Further, the electrode may be removed from the electrode well after heating the formation and the well used as a producer of the in situ fluid or as an injector of drive fluids. The farther away from the electrode well that the satellite well can be positioned and still provide fluid communication for circulation of solution between the two the better. This will effectively increase the size of the electrode to allow more power to the formation as heat energy through better conduction of electricity between electrode wells. A suitable distance between satellite and electrode wells is from about 10 to about 40 feet.

The current flowing from the formation may range from 100 to 1000 or more amperes. This current may require from 100 to 1000 or more volts between the electrode wells, regardless of whether the electrode wells are adjacent or diagonally opposite wells. If desired, the voltage may be increased commensurate with the distance between the wells.

The electrodes may be connected with suitable voltage differential between adjacent wells in a given pattern. On the other hand, the electrodes may be connected with the voltage differential between diagonally opposed wells in the pattern. Any other suitable patterning or configuration of the electrodes and the voltage differentials may be employed as desired.

Water containing dissolved electrolyte is injected into one or more electrode wells to establish and maintain a region of high electrical conductivity about each of the wells and to electrically connect the region of high electrical conductivity with the electrical conductors in the well and with the conductive phase in the subterranean formation. The electrode well should also be completed so as to enable the release of initial expansion caused by preheating. After the in situ fluid in the area between an electrode well and a satellite well becomes mobile through preheating, an electrolyte solution can be circulated between the satellite and electrode wells to increase substantially the area of high conductivity. Then viscous oil mobilized during preheating can be produced through the satellite wells to allow for thermal expansion of the reservoir without fracturing. Power output can also be increased without danger of reheating, when the entire area between satellite wells and electrode wells has been completely flushed with electrolyte solution. This circulation of solution will keep the temperature in the wellbore vicinity below the vaporization temperature of water, thereby preventing steam production. The amount of water containing dissolved electrolyte necessary will vary from one formation to the next but should be more than is necessary for establishing an electrical bridge, or an electrical connection between the electrode and the face of the formation, but less than the amount needed to flood through the formation.

The circulation of electrolyte solution also provides a medium for transferring heat from cable present in electrode wells achieving an increase in current capacity therein.

The water containing dissolved electrolyte should contain at least 2 to 3 percent by weight of the dissolved electrolyte and should be substantially saturated with the dissolved electrolyte at the temperature at which it is injected into the formation. With sodium chloride, this may be as much as 35 percent by weight. With calcium chloride, the solution may contain as much as 59 percent by weight. As the temperature increases in the tar sand formation, there will ordinarily be a decrease in the saturation of the dissolved electrolyte, the relative saturation may decrease dramatically with calcium chloride. Ordinarily, however, the decrease in relative saturation will not substantially alter the electrical conductivity. It is particularly appropriate to employ substantially saturated electrolytic solutions when the solutions will be diluted by the connate water, by condensed steam or otherwise.

The subterranean formation can be heated intermediate electrode wells by electrical conduction between the wells. The higher conductivity provided through the circulation of brine between electrode wells and adjacent satellite wells enables passing a higher current between the electrode wells than would otherwise be feasible with a given voltage differential.

After sufficient heating has taken place to render the viscous oil mobile, it is produced from the formation by conventional means by converting the electrode wells to injectors and producers via removal of the electrodes. The conventional means may include auxiliary pumping equipment in the production wells. More frequently, a fluid, such as steam, water miscible fluid, natural gas or a combination thereof, will be employed to force the viscous oil to production wells. When a fluid is to be injected, the pressure differential may be increased sufficiently to force the fluids out of production wells to the surface of the earth and obviate the need for auxiliary pumping equipment.

The drilling of the wells and the completion thereof is well-known and need not be described herein.

The emplacement of electrical conductors, such as the electrodes and the electrical connection with the subterranean formation and with suitable surface equipment having the source of voltage differential is also known and need not be described in detail herein. For example, one such electrical interconnection is described in co-pending application Ser. No. 409,063, filed 10–24–74, by Loyd R. Kern, entitled "Method of Producing Bitumen from a Subterranean Tar Sand Formation" and assigned to the assignee of this invention; and the descriptive matter of that application is embodied herein by reference for the details that are omitted herefrom.

The source of voltage differential is preferably alternating current in order to avoid the electrolysis effects of direct current flow.

By water containing dissolved electrolyte is meant an aqueous solution of a strong electrolyte having high electrical conductivity, also referred to as an electrolytic solution. The term water is used herein to include dilute aqueous solutions, such as surface water, well water, rain water, city water, treated waste water and suitable oil field brine. By electrolyte is meant a strongly ionizing salt. A strong electrolyte is discussed and its requirements set forth at page 506 of OUTLINES OF PHYSICAL CHEMISTRY, Farrington Daniel, John Wylie and Sons, Inc., New York, 1948. Soluble inorganic salts are illustrative of salts which form strong electrolytes. The alkali metal halides typify such inorganic salts. Calcium chloride may be employed if desired. Illustrative of other inorganic salts which form strong electrolytes is tetrasodiumpyrophosphate. Mixtures of the salts may also be employed.

The following example illustrates applicability of this invention to effect the lowering of the electrical resistance of a formation.

Example

| | |
|---|---|
| Formation thickness, | 50 ft. |
| Formation porosity, | 30% |
| Water saturation, | 30% |
| Oil saturation, | 70% |
| NaCl content of water, | 1% by weight |
| Electrical resistivity of formation water at formation temperature, | .3 ohm-meters |
| Electrical resistivity of formation, | 140 ohm-meters |
| Oil viscosity, | 100 cp |
| NaCl content of injected electrolyte solution, | 5% by weight |
| Electrical resistivity of injected electrolyte solution at formation temperature, | .06 ohm-meters |
| Distance between satellite well and electrode well, | 30 ft. |

A 421 bbl volume of the electrolyte solution is injected into the formation through the electrode bore hole. This injected volume of solution banks up and displaces the formation water which in turn displaces part of the oil, reducing its saturation from 70% to 50%. Initially, the injected electrolyte solution travels through the porous formation a distance of about 10 ft. from the center of the wellbore and occupies 50% of the pore space within this 10 ft. radius. In addition, in the interval space from 10 ft. to 12.6 ft., the oil saturation is reduced from 70% to 50% by the banked up formation water. In this interval space, because formation water occupies 50% of the pore space, formation resistivity is reduced from 140 ohm-meters to 63 ohm-meters. In the 10 ft. interval adjacent the wellbore, the resistivity is reduced another five-fold because the injected electrolyte solution has a resistivity one-fifth that of the formation water. Therefore, in the 10 ft. interval adjacent the wellbore, the formation resistivity is reduced from 140 ohm-meters to 12.6 ohm-meters.

The effect of the pressure differential created by the adjacent satellite causes the electrolyte solution to migrate toward the satellite well. Subsequently, after preheating and production of initial expansion, the electrolyte solution fills the region between the electrode and the satellite well reducing the formation resistivity to 12.6 ohm-meters, thereby obtaining an enlarged effective electrode area of high conductivity to improve electrical connection with other electrode wells completed in the formation. Upon establishment of communication between the electrode well and the satellite well, the electrolyte solution is continuously withdrawn from the formation through the satellite well, passed through a heat exchanger and reinjected through the electrode wellbore to complete the cycle of the circulation system.

The water containing the dissolved electrolyte may be injected concurrently or intermittently with the electrical conduction to establish and maintain the region of high electrical conductivity. When it is injected concurrently with heating, precaution should be taken to ensure that no electrically complete conductive path is established intermediate the high voltage electrodes and the injection conduits or otherwise pose hazards to operating personnel.

It is realized that there are hazards attendant to operating with high voltage and high current flows but, these hazards and safety precautions to alleviate the hazards are well-known and need not be described herein.

From the foregoing, it can be seen that this invention provides a method of heating a subterranean formation that accomplishes the objects delineated hereinbefore. Specifically, the method of this invention provides an enlarged region of high electrical conductivity about the respective wells, the region where there is greatest current densities and where the resistance is usually the highest. This high resistance region has, heretofore, wasted electrical energy without beneficial heating of the formation and the in situ fluid. Further, the invention provides a method for producing initial expansion fluids during heating and provides for cooling of the electrode wellbores to allow more power to reach the formation in the form of heat energy.

Having thus described the invention, it will be understood that such description has been given by way of illustration and example and not by way of limitation, reference for the latter purpose being had to the appended claims.

I claim:

1. In a method of recovering an in situ fluid from a subterranean formation containing viscous oil via heating with electrical conduction between a plurality of electrode wells completed therein, in order to improve the conductivity between said electrode wells, the improvement comprises:

drilling and completing a satellite well in said formation and adjacent an electrode well, injecting water containing dissolved electrolyte into said formation via an electrode well having an adjacent satellite well, establishing fluid communication between said electrode well and said satellite well by repeated steps of heating and producing mobilized in situ fluid situated therebetween, and circulating said water containing dissolved electrolyte between said electrode well and adjacent satellite well.

2. The improvement of claim 1 wherein said circulation is provided by withdrawing said injected water from said formation through said satellite well and passing same through a heat exchanger at the surface and reinjecting same into said formation through said electrode well whereby same flows past conductors situated therein.

3. The improvement of claim 1 wherein said circulation is provided by withdrawing said injected water from said formation through said electrode well and passing same through a heat exchanger at the surface and reinjecting same into said formation through said electrode well whereby same flows past conductors situated therein.

4. The improvement of claim 1 wherein said electrode well has adjacent thereto three satellite wells positioned equidistance from said electrode well and each other.

* * * * *